United States Patent [19]

Andersson

[11] Patent Number: 5,027,528

[45] Date of Patent: Jul. 2, 1991

[54] DRYING PLANT

[76] Inventor: Kurt Andersson, Birger Jarlsgatan 102A, 114 20 Stockholm, Sweden

[21] Appl. No.: 442,398

[22] Filed: Nov. 27, 1989

Related U.S. Application Data

[63] Continuation of Ser. No. 201,440, Jun. 2, 1988, abandoned.

[30] Foreign Application Priority Data

Jun. 4, 1987 [SE] Sweden ..... 8702328

[51] Int. Cl.[5] ..... F26B 3/34

[52] U.S. Cl. ..... 34/1; 34/52; 34/105; 219/10.55 A

[58] Field of Search ..... 34/57 R, 105, 106, 4, 34/52, 156, 1; 219/10.55 A

[56] References Cited

U.S. PATENT DOCUMENTS

| | | | |
|---|---|---|---|
| 2,597,923 | 5/1952 | Croston | 156/379.6 |
| 2,635,352 | 4/1953 | Phillips, Jr. | 34/1 |
| 3,111,452 | 11/1963 | Ewing et al. | 34/105 |
| 3,310,653 | 3/1967 | Crockett | 34/4 X |
| 3,329,796 | 7/1967 | Manwaring | 219/10.55 |
| 4,033,263 | 7/1977 | Richmond | 34/52 X |
| 4,142,304 | 3/1979 | Ricci et al. | 34/105 |
| 4,428,127 | 1/1984 | Grassman | 34/105 X |

*Primary Examiner*—Albert J. Makay
*Assistant Examiner*—John Sollecito
*Attorney, Agent, or Firm*—Burns, Doane, Swecker & Mathis

[57] ABSTRACT

The present invention relates to a drying plant which is intended for drying one or more objects (3, 3') having a cylindrical outer surface, e.g. tubular cores for paper rolls, and which utilizes high frequency apparatus with associated electrodes (10, 11), and means (12, 13) for moving the object between the electrodes during the drying process. In accordance with the invention the object is rotated about its longitudinal axis or rolled along a horizontal flat path formed by the lower electrode (10) during passage of the object through the drying plant.

7 Claims, 1 Drawing Sheet

DRYING PLANT

This application is a continuation of application Ser. No. 201,440, filed June 2, 1988 now abandoned.

TECHNICAL FIELD

The present invention relates generally to a drying plant, and more particularly, although not exclusively, to a drying plant which is constructed to dry homogeneous or hollow, cylindrical objects having cylindrical outer surfaces. More specifically, the invention relates to a drying plant for drying cylindrical tubes which comprise wound adhesive-coated paper strips and which are intended to form the tubular cores of paper rolls.

Immediately after manufacture, such tubes normally have a moisture content in excess of 15%, and subsequent to being dried the tubes are required to have a straight linear extension and a symmetrical circular cross-sectional shape to within small tolerances.

Such tubes can be used as the cores upon which paper is wound from a paper machine, to form paper rolls. Such tubes normally have a length of 10 meters or more.

For this specific technical purpose it is proposed in accordance with the invention that there is used a principally known drying plant which utilizes high frequency apparatus in which the object to be dried, or the newly produced tube, is introduced between electrodes forming part of the high frequency apparatus.

The invention also proposes the use of means for moving the objects or tubes between electrodes, from the input side to the output side of the drying plant during the drying process.

The inventive drying plant is particularly adapted to enable it to be connected to a machine or apparatus on which the aforesaid moisture-containing tubes are produced continuously, so that drying of the tubes can be commenced immediately the tubes leave the machine. Such tubes are produced by winding a plurality of adhesive-coated paper strips around a cylindrical iron mandrel and dividing the resultant tube into required lengths. The tubes have a moisture content of about 17% upon being discharged from the forming machine and must be dried to a moisture content of only some few percent, e.g. between 5 and 7%.

BACKGROUND PRIOR ART

It is known to dry cylindrical objects and in particular tubular cores for paper rolls, in drying plants, by arranging the moist tubes in rows and columns and to introduce the tube formation into a special drying plant or drying chamber which is ventilated with hot air.

The tubes are dried very slowly and are held in the drying chamber for a very long time, so that no distortion will occur in the tubes, such as curving of the tubes along their longitudinal axes or deviation from a true circle in cross-section.

It is also known with such drying plants to take measures which will ensure that respective tubes are maintained in their given order of formation.

It can be mentioned that the lengths of tubes which are used as cores for paper rolls normally vary from between 1 and 12 meters.

Various high frequency dryers are known to the art for different specific fields and technical applications. An example of such dryers is described and illustrated in U.S. Pat. No. 3,329,796. Reference is also made to the apparatus described and illustrated in U.S. Pat. No. 2,597,923.

SUMMARY OF THE PRESENT INVENTION

Technical Problems

When considering the known state of this art as described in the aforegoing, it will be apparent that a qualified technical problem must lie in the provision of a drying plant for drying objects with cylindrical outer surfaces, particularly tubular cores for paper rolls, which will enable the objects to be dried more easily and more quickly than can be achieved hitherto, but which will ensure that the objects retain their desired shapes despite being dried more rapidly, or at least will not be deformed to extents which lie beyond predetermined tolerance limits.

Another technical problem lies in realizing that when subjecting straight cylindrical objects to quick drying processes the straightness of these objects can be maintained by rolling the objects against a flat supporting surface during the drying process.

A further technical problem lies in realizing that this rolling motion of cylindrical objects about their longitudinal axes along a flat supporting surface in order to retain the straightness of said objects when subjected to quick drying processes can be applied highly successfully to tubes which are wound from paper strips moistened with adhesive and which are intended to form the cores of paper rolls of great width.

Another technical problem resides in the provision of a drying plant which requires much less floor space than previously known drying plants of the same drying capacity.

With regard to drying plants of the aforesaid kind, a further technical problem resides in realizing the significance of such conditions as those which result in the energy requirement of the drying plant being adapted to the prevailing moisture content of the objects or tubes and that this requirement is independent of the longitudinal extensions of the objects, in combination with simple adjustment of the intended and utilized power input for drying purposes.

Solution

The present invention relates to a drying plant which is adapted for drying objects exhibiting cylindrical outer surfaces, e.g. tubular cores for paper rolls, and which utilizes known high frequency apparatus with associated electrodes and means for feeding or displacing the objects between the electrodes during the drying process.

In order to allow the objects or tubes to be dried quickly without losing their straightness it is proposed in accordance with the invention that when using such drying plants the objects or tubes are caused to rotate about their longitudinal axes during at least the greater part of their passage through the drying plant.

Although it is preferred to rotate the objects or tubes during the whole of their passage through the plant, the objects may be rotated through at least 75% of this passage, such that the final stage of the drying process is effected without rotating the objects.

Preferably, the objects are caused to roll along a flat surface through the drying plant.

To this end it is proposed that a transporting arrangement is provided adjacent to, but outwardly of one electrode, and that the transporting arrangement is caused to co-act with electrically non-conductive pins or like dogging elements which are intended to extend through slots in the electrode and to roll the objects through the drying plant.

In accordance with one advantageous embodiment of the invention, at least one of the electrodes, preferably the upper electrode, is capable of being raised and lowered, such that the distance between the electrodes can be adjusted so as to only slightly exceed the diameter of the cylindrical objects being dried, thereby enabling the high frequency apparatus to be used more efficiently.

The invention relates particularly to a drying plant which is constructed for drying continuously produced tubular cores for paper rolls with the aid of high frequency apparatus and associated electrodes, and with the aid of a transporting arrangement by means of which the tubes are rolled along a surface between the electrodes during the drying process.

It is proposed in accordance with the invention that the continuously produced tubes are divided into predetermined lengths and thereafter introduced immediately into the drying plant.

The divided tube is allowed to roll some distance along a lower flat electrode surface through the drying plant while a subsequent tube is produced, divided and fed to the drying plant.

It is proposed that the electrodes of the drying plant have a width which exceeds slightly the maximum length of the tubes, and that means are provided for controlling the speed at which the tubes are moved between the electrodes.

Advantages

Those advantages primarily afforded by the inventive drying plant for use in conjunction with the manufacture of tubular cores for paper rolls, reside in the ability to dry the tubular cores in a short space of time while utilizing only a small amount of space and without causing undesirable changes in the desired configuration of the cores, by which is meant that the dried tubular cores will exhibit a straightness and a roundness which lie within given tolerances.

The primary characteristic features of the inventive drying plant are set forth in the characterizing clauses of the following claim 1 and claim 6.

DESCRIPTION OF THE DRAWINGS

A proposed embodiment of a drying plant will now be described in more detail with reference to the accompanying drawing, in which.

DESCRIPTION OF A PREFERRED EMBODIMENT

Figure 1:
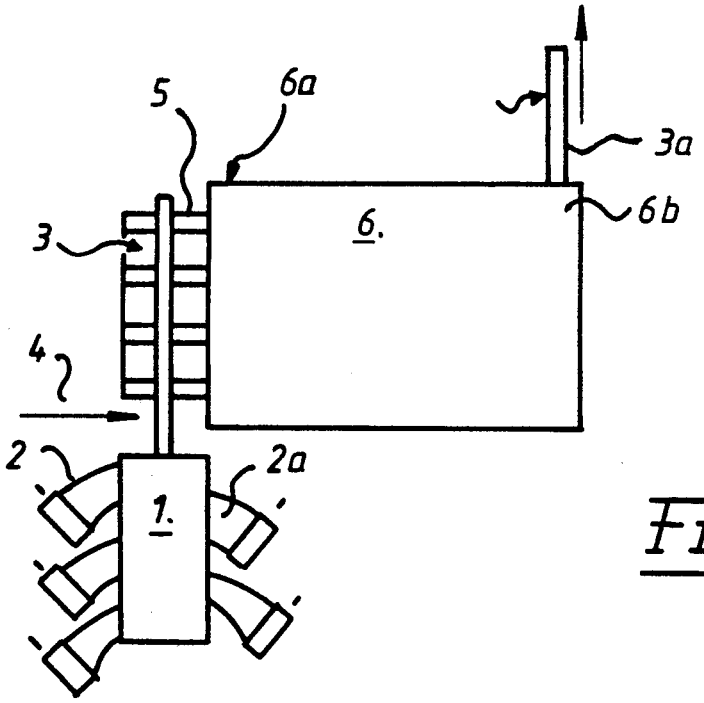
FIG. 1 is a horizontal, greatly simplified view of a plant for continuously producing tubular cores for paper rolls and utilizing a drying plant constructed in accordance with the invention.

FIG. 1 illustrates a known plant for continuously manufacturing tubes upon which a paper web produced on a paper machine can be wound, to form paper rolls. Thus, in the manufacture of a tube a plurality of paper strips 2, 2*a*, . . . moistened with adhesive are wound onto an iron mandrel (not shown) in a known plant 1, and the tube is advanced from the tube manufacturing plant progressively in an upward direction in FIG. 1 as the tube is produced.

The thus produced tube 3 has a moisture content corresponding approximately to 17%, and may have an outer diameter of 120 mm and a central hollow of 70 mm in diameter.

The tube may be fed from the plant at a speed of 30 m/min.

The tube 3 exiting from the tube manufacturing plant is divided into a pre-determined length by means of a tube cutting device 4 of known kind shown very schematically in FIG. 1. The tube of given length is then fed into the inventive drying plant 6 by means of a feed arrangement 5.

Subsequent to entering the drying plant 6 through the in-feed side 6*a* thereof, the tube 3 is fed through the drying plant with the aid of known means and out through the out-feed side 6*b* of the drying plant 6, and exits in the form of a dry, straight and generally circular-symmetrical shape-stable tube 3*a*.

Figure 2:
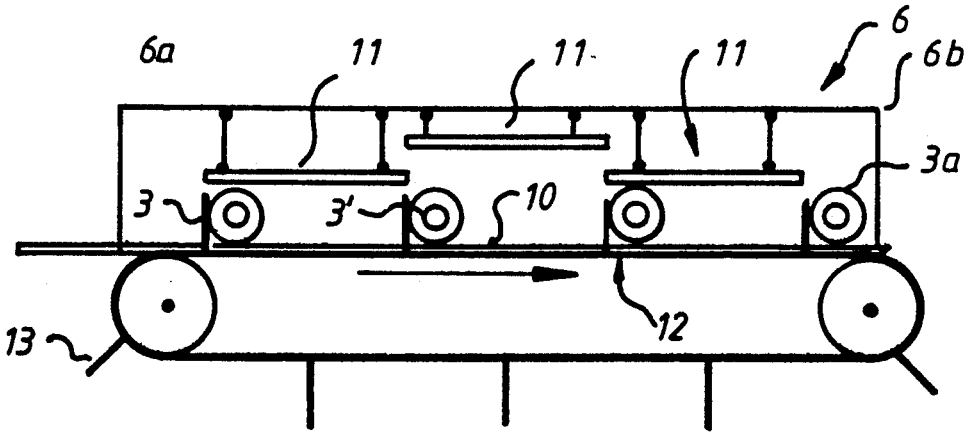
FIG. 2 is a schematic sectioned side view of the drying plant according to the invention.

The high frequency apparatus used in conjunction with the present invention is of a known kind and capable of generating 500 kW energy and comprises an upper and a lower electrode, referenced 10 and 11 in FIG. 2, of which the lower electrode 10 consists of a flat, horizontally extending aluminium plate which incorporates a plurality of longitudinally extending and mutually parallel narrow slots, whereas the upper electrode 11 is composed of three mutually separate but electrically connected plates.

As will be understood from FIG. 2, the illustrated drying plant is intended for drying objects which present cylindrical outer surfaces, for instance tubular cores for paper rolls, and utilizes high frequency apparatus (not described in detail) with associated electrodes 10, 11, and incorporates transporting means 12, 13 for moving the objects through the drying plant and between the upper and lower electrodes during the drying process. In accordance with the invention, the objects or tubes 3 are rotated about their longitudinal axes during the whole of their passage through the drying plant, or at least during a greater part of this passage.

The objects are preferably rotated about their longitudinal axes along at least 75% of their transport path through the drying plant by a rolling motion along a support surface.

A particular advantage is afforded when the objects or tubes are rolled along a flat surface through the drying plant 6 with the aid of the transport means 12, said support surface comprising the upper surface of the lower electrode 10.

The transporting means 12 is arranged adjacent to, but outwardly of, or beneath, the one electrode 10 and co-acts with a plurality of mutually spaced, electrically non-conductive pins 13 which are intended to extend through the narrow slots in the lower electrode 10 and therewith roll the objects through the drying plant 6.

The distance between mutually adjacent pins is slightly greater than the diameter of the objects or tubular cores being dried.

At least one of the electrodes, e.g. the upper electrode 11, can be raised and lowered such as to enable the vertical distance between the electrodes 10 and 11 to be adjusted to a value which only slightly exceeds the diameter of the objects being dried.

As will be seen from FIG. 1, the drying plant 6 is constructed for drying continuously produced tubes which are intended to form the cores of paper rolls while utilizing a high frequency apparatus with associated electrodes, and a transporting arrangement for rolling the tubes along a path between the electrodes during the drying process. The continuously produced tubes are divided into a predetermined length and then fed to the infeed side of the drying plant. The divided tubes are allowed to roll a certain distance through the drying plant during the production of a subsequent tube, which is also divided into a given length and thereafter fed to the drying plant.

The width of the electrodes will slightly exceed the maximum length of the divided tubes or cores.

The speed at which the tubes are transported between the electrodes is such that a divided tube is able to enter the drying plant before manufacture of the following tube is completed.

Since the tubes can be divided into different lengths it is proposed that the tube transporting speed can be controlled and adjusted to suitable values. In practice the tubes may be transported at a speed ranging between 0.2 and 5 m/min.

In accordance with one advantageous embodiment of the invention the pins or dogging elements 13 are pivotally mounted, so that when the objects or tubes have a larger diameter than the spacing between two mutually adjacent pins 13, each alternate pin or each third pin, etc., can be swung to one side, thereby enabling the pins to accommodate the objects or tubes of larger diameter.

The distance between the pins associated with different transporting arrangements in the direction of the longitudinal axis of the tube may exceed 0.5 m and is preferably about 1.0 m or slightly thereabove.

It will be understood that the tube or object transporting arrangement may have a construction totally different to that illustrated and described, provided that the pins or like dogging elements used are able to roll the tubes along the electrode 10.

Excessively high drying effects can result in damage to the tubes, and consequently the power input and the speed at which the tubes are transported through the drying plant are dependent upon one another and also on the size of the tubes or objects, their shape and the material from which they are made.

It will be understood that the invention is not restricted to the aforedescribed and illustrated exemplifying embodiment and that modifications can be made within the scope of the invention as set forth in the following claims.

I claim:

1. A drying plant for drying one or more objects having a cylindrical outer surface, comprising: a high frequency apparatus with associated electrodes; and means for transporting the object between said electrodes during the drying process, said means arranged adjacent to but outwardly of one electrode and co-acting with a plurality of mutually spaced electrically non-conductive pins which extend beyond the electrode into rolling contact with the object so as to roll the object on a flat surface during part of its passage through the drying plant, the width of the flat surface being not substantially less than the length of the object.

2. A drying plant according to claim 1, characterized in that the object is arranged to rotate during at least 75% of its passage through the drying plant.

3. A drying plant according to claim 1, characterized in that at least one electrode can be raised and lowered in a manner to enable the distance between the electrodes to be adjusted so as to only lightly exceed the diameter of the object.

4. A drying plant for drying continuously produced tubular cores for paper rolls, comprising: a high frequency apparatus with associated electrodes; and a transporting arrangement for rolling the tubes between said electrodes during the drying process, said transporting arrangement arranged adjacent to but outwardly of one electrode and co-acting with a plurality of mutually spaced electrically non-conductive pins which extend beyond the electrode into rolling contact with the object so as to roll the object on a flat surface during part of its passage through the drying plant, the width of the flat surface being not substantially less than the length of the object, wherein the continuously produced tubes are divided into predetermined lengths and then fed into the drying plant, and said divided tube is allowed to roll a distance along said flat surface through the drying plant during the production of a following tube, which is also divided and fed to the drying plant.

5. A drying plant according to claim 4, characterized in that the width of the electrodes slightly exceeds the maximum length of the divided tubes.

6. A drying plant according to claim 4, characterized in that the speed at which the tubes are transported between the electrodes can be controlled.

7. A drying plant according to claim 5, characterized in that the speed at which the tubes are transported between the electrodes can be controlled.

* * * * *